US010699655B2

(12) United States Patent
Kim et al.

(10) Patent No.: US 10,699,655 B2
(45) Date of Patent: Jun. 30, 2020

(54) DISPLAY DEVICE, DISPLAY PANEL, DRIVING METHOD, AND GATE DRIVER CIRCUIT

(71) Applicant: LG DISPLAY CO., LTD., Seoul (KR)

(72) Inventors: Bonghwan Kim, Paju-si (KR); Wan Sik Lim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 15/839,533

(22) Filed: Dec. 12, 2017

(65) Prior Publication Data

US 2018/0190224 A1 Jul. 5, 2018

(30) Foreign Application Priority Data

Dec. 30, 2016 (KR) ..... 10-2016-0183938

(51) Int. Cl.

| | |
|---|---|
| ***G09G 3/36*** | (2006.01) |
| ***G09G 3/3266*** | (2016.01) |
| ***G09G 3/3233*** | (2016.01) |
| ***G09G 3/02*** | (2006.01) |
| ***G09G 3/20*** | (2006.01) |
| ***G09G 3/34*** | (2006.01) |

(52) U.S. Cl.

CPC ..... *G09G 3/3648* (2013.01); *G09G 3/02* (2013.01); *G09G 3/2085* (2013.01); *G09G 3/3233* (2013.01); *G09G 3/3266* (2013.01); *G09G 3/342* (2013.01); *G09G 2300/0426* (2013.01); *G09G 2300/0819* (2013.01); *G09G 2300/0842* (2013.01); *G09G 2320/0223* (2013.01); *G09G 2320/045* (2013.01)

(58) Field of Classification Search

CPC ..... G09G 3/3648

See application file for complete search history.

(56) References Cited

U.S. PATENT DOCUMENTS

| | | | | |
|---|---|---|---|---|
| 2005/0104826 | A1 | 5/2005 | Baek et al. | |
| 2008/0111777 | A1* | 5/2008 | Kim | G09G 3/3233 345/83 |
| 2009/0109146 | A1* | 4/2009 | Minami | G09G 3/3233 345/76 |
| 2009/0213148 | A1* | 8/2009 | Takasugi | G09G 3/3233 345/690 |
| 2016/0117987 | A1* | 4/2016 | Byun | G09G 3/3233 345/205 |

FOREIGN PATENT DOCUMENTS

KR 10-2008-0048716 A 6/2008

* cited by examiner

*Primary Examiner* — Kent W Chang
*Assistant Examiner* — Chayce R Bibbee
(74) *Attorney, Agent, or Firm* — Seed IP Law Group LLP

(57) ABSTRACT

A display device, a display panel, a driving method, and a gate driver circuit. Threshold voltage sampling times of driving transistors are changed by varying pulse widths of gate clock signals depending on horizontal lines. Luminance uniformity of the display panel is improved, even in the case in which horizontal line-specific driving voltages have different voltage drops.

9 Claims, 14 Drawing Sheets

DISPLAY DEVICE, DISPLAY PANEL, DRIVING METHOD, AND GATE DRIVER CIRCUIT

CROSS REFERENCE TO RELATED APPLICATION

This application claims priority from Korean Patent Application No. 10-2016-0183938, filed on Dec. 30, 2016, which is hereby incorporated by reference in its entirety for all purposes as if fully set forth herein.

BACKGROUND

Technical Field

The present disclosure relates to a display device, a display panel, a driving method, and a gate driver circuit.

Description of the Related Art

In response to the development of the information society, there has been increasing demand for display devices able to display images. Recently, a range of display devices, such as liquid crystal display (LCD) devices, plasma display panels (PDPs), and organic light-emitting display devices, have come into widespread use.

Among such display devices, organic light-emitting display devices have desirable qualities, such as rapid response rates, wide viewing angles, and high levels of luminance, since organic electroluminescent (EL) devices or organic light-emitting diodes (OLEDs) able to emit light themselves are used therein.

Display panels may suffer from position-specific luminance deviations due to a variety of reasons. Such luminance deviations may lead to degradations in the quality of images displayed by display devices.

BRIEF SUMMARY

Various aspects of the present disclosure provide a display device, a display panel, a display method, and a gate driver circuit, in which the luminance uniformity of a display panel can be improved, even in the case in which position-specific driving voltage deviations occur in the display panel.

Also provided are a display device, a display panel, a display method, and a gate driver circuit, in which the luminance uniformity of the display panel can be improved, even in the case in which the driving transistors have different threshold voltage sampling times.

Also provided are a display device, a display panel, a display method, and a gate driver circuit, in which the luminance uniformity of the display panel can be improved by changing threshold voltage sampling times of the driving transistors.

Also provided are a display device, a display panel, a display method, and a gate driver circuit, in which the luminance uniformity of the display device can be improved by changing the threshold voltage sampling times of the driving transistors by varying pulse widths of gate pulse signals.

Also provided are a display device, a display panel, a display method, and a gate driver circuit, in which the luminance uniformity of the display device can be improved by changing the threshold voltage sampling times of the driving transistors by varying pulse widths of scanning signals.

According to example embodiments, a display device may include a display panel including an arrangement of a plurality of data lines, an arrangement of a plurality of gate lines, and an array of a plurality of subpixels defined by the plurality of data lines and the plurality of gate lines. The display device also includes a gate driver circuit generating scanning signals using two or more gate clock signals having different phases and transferring the scanning signals to the plurality of gate lines.

Each of the clock signals may include a plurality of pulses including a first pulse and a second pulse following the first pulse.

The first pulse and the second pulse may have different pulse widths.

In each of the gate clock signals, the first pulse may correspond to a first horizontal line in the display panel, and the second pulse may correspond to a second horizontal line in the display panel, the second horizontal line being located farther from driving voltage supply positions than the first horizontal line is.

A path on which a driving voltage is delivered to a subpixel among the plurality of subpixels, disposed on the second horizontal line, may be longer than a path on which a driving voltage is delivered to a subpixel among the plurality of subpixels, disposed on the first horizontal line.

In each of the gate clock signals, the pulse width of the second pulse may be shorter than the pulse width of the first pulse.

Consequently, during driving, the subpixel arranged on the second horizontal line has a shorter threshold voltage sampling time than the subpixel arranged on the first horizontal line.

According to example embodiments, a method of driving a display device may include: adjusting pulse widths of two or more gate clock signals having different phases; generating scanning signals using the gate clock signals; and outputting the scanning signals to the plurality of gate lines.

Each of the two or more gate clock signals may include a plurality of pulses including a first pulse and a second pulse following the first pulse. Pulse widths of the first pulse and the second pulse are adjusted to be different.

According to example embodiments, a display panel may include a plurality of data lines for delivering data voltages, a plurality of gate lines for delivering scanning signals, two or more gate clock signal lines for delivering two or more gate clock signals having different phases, and a plurality of subpixels defined by the plurality of gate lines.

In the display panel, each of the plurality of subpixels may include an organic light-emitting diode (OLED), and a driving transistor for driving the OLED, the driving transistor including a first node at which a driving voltage is applied, a second node corresponding to a gate node, and a third node electrically connected to the OLED. A subpixel may also include a first transistor electrically connected between the first node of the driving transistor and a data line among the plurality of data lines; a second transistor electrically connected between the second node and the third node of the driving transistor; and a capacitor electrically connected between the first node and the second node of the driving transistor.

Each of the two or more gate clock signals may include a plurality of pulses including a first pulse and a second pulse following the first pulse.

The first pulse and the second pulse may have different pulse widths.

According to example embodiments, a gate driver circuit may include: a first input node at which a gate clock signal is input; a second input node at which a power voltage is input; a signal generating circuit generating a scanning signal in response to the gate clock signal; and an output node outputting the scanning signal to a gate line.

In the gate driver circuit, the gate clock signal may include a plurality of pulses including a first pulse and a second pulse following the first pulse, the first pulse and the second pulse having different pulse widths.

According to example embodiments, a display device may include a display panel having an arrangement of a plurality of data lines, an arrangement of a plurality of gate lines, and an array of a plurality of subpixels defined by the plurality of data lines and the plurality of gate lines. A display device may also include a gate driver circuit for generating scanning signals using two or more gate clock signals having different phases and for transferring the scanning signals to the plurality of gate lines.

The gate driver circuit may transfer the scanning signals having different pulse widths depending on horizontal lines corresponding to subpixel lines of the plurality of subpixels.

The pulse width of a scanning signal of the scanning signals transferred to a gate line among the plurality of gate lines, arranged on the second horizontal line located farther from driving voltage supply positions at which driving voltages are supplied to the display panel, may be shorter than the pulse width of a scanning signal of the scanning signals transferred to a gate line among the plurality of gate lines, arranged on the first horizontal line located closer to the driving voltage supply positions at which the driving voltages are supplied to the display panel.

According to example embodiments, in the display device, the display panel, the display method, and the gate driver circuit, it is possible to improve the luminance uniformity of the display panel, even in the case in which position-specific driving voltage deviations occur in the display panel.

According to example embodiments, in the display device, the display panel, the display method, and the gate driver circuit, it is possible to improve the luminance uniformity of the display panel, even in the case in which the driving transistors have different threshold voltage sampling times.

According to example embodiments, in the display device, the display panel, the display method, and the gate driver circuit, it is possible to improve the luminance uniformity of the display panel by changing threshold voltage sampling times of the driving transistors.

According to example embodiments, in the display device, the display panel, the display method, and the gate driver circuit, it is possible to improve the luminance uniformity of the display device by changing the threshold voltage sampling times of the driving transistors by varying pulse widths of gate pulse signals.

According to example embodiments, in the display device, the display panel, the display method, and the gate driver circuit, it is possible to improve the luminance uniformity of the display device by changing the threshold voltage sampling times of the driving transistors by varying pulse widths of scanning signals.

BRIEF DESCRIPTION OF THE DRAWINGS

The above and other objects, features and advantages of the present disclosure will be more clearly understood from the following detailed description when taken in conjunction with the accompanying drawings, in which.

DETAILED DESCRIPTION

Figure 1:
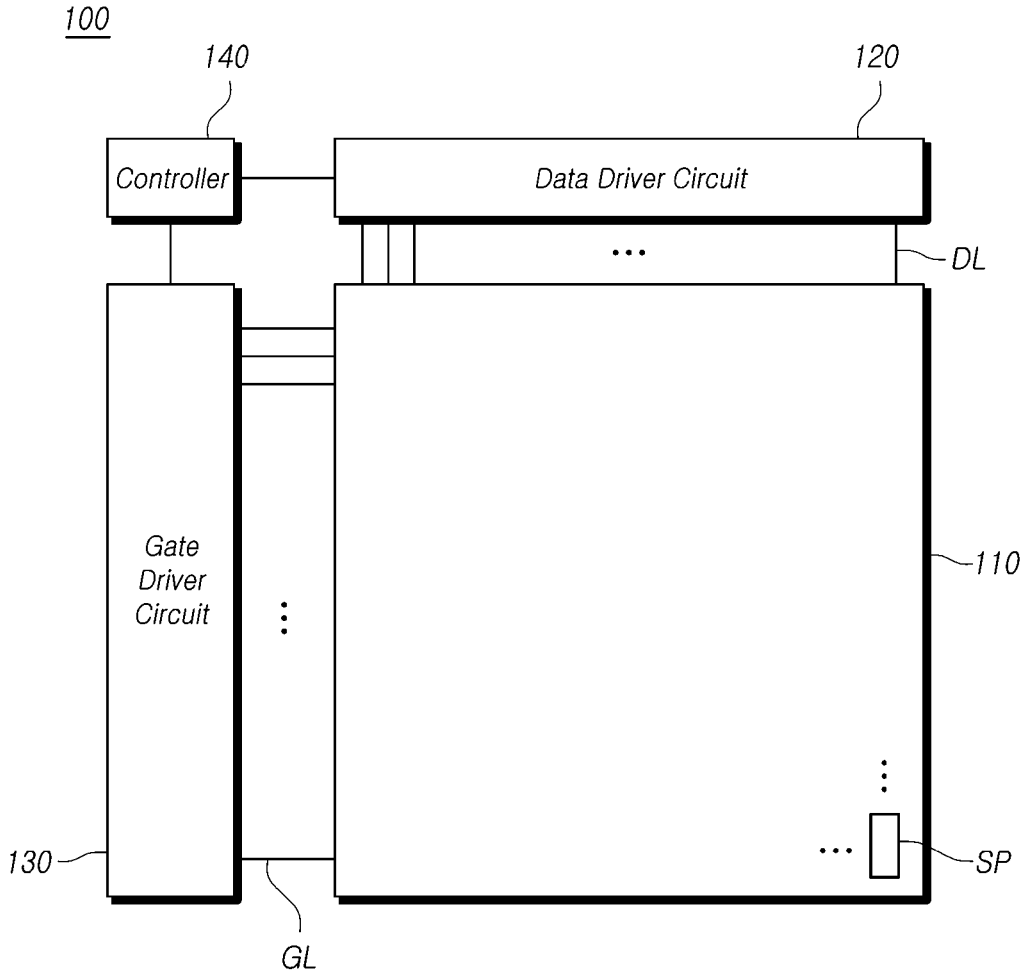
FIG. 1 illustrates a system configuration of a display device according to example embodiments.

Hereinafter, reference will be made to embodiments of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first," "second," "A," "B," "(a)," and "(b)" may be used herein to describe various elements, such terms are merely used to distinguish one element from another element. The substance, sequence, order, or number of these elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 illustrates a system configuration of a display device 100 according to example embodiments.

The display device 100 according to example embodiments includes a display panel 110 having an arrangement of a plurality of data lines DL, an arrangement of a plurality of gate lines GL, and an array of a plurality of subpixels SP defined by the plurality of data lines DL and the plurality of gate lines GL. The display device 100 also includes a data driver circuit 120 for driving the plurality of data lines DL, a gate driver circuit 130 for driving the plurality of gate lines GL, and a controller 140 controlling the data driver circuit 120 as well as the gate driver circuit 130.

The controller 140 controls the data driver circuit 120 and the gate driver circuit 130 by transferring a variety of control signals to the data driver circuit 120 and the gate driver circuit 130.

The controller 140 starts scanning based on timing realized in each frame, converts image data input from an external source into a data signal format readable by the data driver circuit 120 before outputting converted image data, and regulates data processing at suitable points in time in response to the scanning.

The controller 140 may be a timing controller used in the field of typical display technology or a control device performing other control functions, including the function as the timing controller.

The data driver circuit 120 drives the plurality of data lines DL by supplying data voltages to the plurality of data lines DL. Herein, the data driver circuit 120 is also referred to as a "source driver circuit."

The gate driver circuit 130 sequentially drives the plurality of gate lines GL by sequentially transferring scanning signals to the plurality of gate lines GL. Herein, the gate driver circuit 130 is also referred to as a "scanning driver circuit."

The gate driver circuit 130 sequentially transfers scanning signals respectively having an on or off voltage to the plurality of gate lines GL, under the control of the controller 140.

When a specific gate line among the plurality of gate lines GL is opened by the gate driver circuit 130, the data driver circuit 120 converts image data received from the controller 140 into analog data voltages and supplies the analog data voltages to the plurality of data lines DL.

Although the data driver circuit 120 is illustrated as being located on one side of (e.g., above or below) the display panel 110 in FIG. 1, the data driver circuit 120 may be located on both sides of (e.g., above and below) the display panel 110, depending on the driving system, the design of the panel, or the like.

Although the gate driver circuit 130 is illustrated as being located on one side (e.g., to the right or the left) of the display panel 110 in FIG. 1, the gate driver circuit 130 may be located on both sides (e.g., to the right and the left) of the display panel 110, depending on the driving system, the design of the panel, or the like.

The controller 140 may receive, in addition to input video data, a variety of timing signals, including a vertical synchronization (Vsync) signal, a horizontal synchronization (Hsync) signal, an input data enable (DE) signal, a clock signal, and the like, from an external source (e.g., a host system).

The controller 140 not only converts image data input from the external source into a data signal format readable by the data driver circuit 120 before outputting converted image data, but also generates a variety of control signals by receiving a variety of timing signals, such as a Vsync signal, an Hsync signal, an input DE signal, and a clock signal, and outputs the variety of control signals to the data driver circuit 120 and the gate driver circuit 130 in order to control the data driver circuit 120 and the gate driver circuit 130.

For example, the controller 140 outputs a variety of gate control signals (GCSs), including a gate start pulse (GSP), a gate shift clock (GSC), a gate output enable (GOE) signal, and the like, to control the gate driver circuit 130.

Among these signals, the GSP controls the operation start timing of one or more gate driver integrated circuits (ICs) of the gate driver circuit 130. The GSC is a clock signal commonly input to the one or more gate driver ICs of the gate driver circuit 130 to control the shift timing of scanning signals (or gate pulses). The GOE signal designates timing information of the one or more gate driver ICs of the gate driver circuit 130.

In addition, the controller 140 outputs a variety of data driving control signals, including a source start pulse (SSP), a source sampling clock (SSC), a source output enable (SOE) signal, and the like, to control the data driver circuit 120.

Among these signals, the SSP controls the data sampling start timing of one or more source driver ICs of the data driver circuit 120. The SSC is a clock signal controlling the sampling timing of data in each of the source driver ICs. The SOE signal controls the output timing of data of the data driver circuit 120.

The data driver circuit 120 includes the one or more source driver ICs (SDICs) to drive the plurality of data lines DL.

The source driving ICs may be connected to the bonding pads of the display panel 110 by tape-automated bonding (TAB) or by a chip-on-glass (COG) method, may be directly mounted on the display panel 110, or in some cases, may be integrated with the display panel 110. The source driving ICs may also be implemented as chip-on-film (COF) source driving ICs that are mounted on a film connected to the display panel 110.

Each of the source driver ICs includes a shift register, a latch circuit, a digital-to-analog converter (DAC), an output buffer, and the like.

In some cases, each of the source driver ICs may further include an analog-to-digital converter (ADC).

The gate driver circuit 130 includes one or more gate driver ICs (GDICs).

The gate driver ICs may be connected to the bonding pads of the display panel 110 by tape-automated bonding (TAB) or by a chip-on-glass (COG) method, may be implemented as gate-in-panel (GIP) gate driver ICs that are directly mounted on the display panel 110, or in some cases, may be integrated with the display panel 110. The gate driver ICs may also be implemented as chip-on-film (COF) gate driver ICs that are mounted on a film connected to the display panel 110.

Each of the gate driver ICs includes a shift register, a level shifter, and the like.

The data driver circuit 120 and the gate driver circuit 130 may be implemented as separate driver circuits or may be integrated as a single driver circuit.

The display device 100 according to example embodiments may be one of a variety of display devices, such as a liquid crystal display (LCD) device, an organic light-emitting display device, and a plasma display device.

Each of the plurality of subpixels SP disposed in the display panel 110 includes circuit components, such as a transistor.

For example, when the display panel 110 is an organic light-emitting display panel, each of the subpixels SP includes circuit components, such as an organic light-emitting diode (OLED) and a driving transistor for driving the OLED.

The type and number of circuit components of each of the subpixels SP may be variously determined, depending on the function and design of the subpixel.

As described above, in the display panel 110 according to example embodiments, the plurality of data lines DL through which data voltages VDATA are delivered, the plurality of gate lines GL through which a scanning signal(s) SCAN is delivered, and the plurality of subpixels SP defined by the plurality of data lines DL and the plurality of gate lines GL are arranged in the form of a matrix.

Each of the subpixels SP receives a data voltage VDATA supplied from a single data line among the plurality of data lines DL.

Each of the subpixels SP receives one scanning signal or two or more scanning signals from one gate line or two or more gate lines among the plurality of gate lines GL.

The number and types of scanning signals transferred to each of the subpixels SP may vary depending on the subpixel structure (i.e., the number and types of transistors in the subpixel SP).

Hereinafter, the subpixel structure in the case in which the display device 100 according to example embodiments is an organic light-emitting display device will be described with reference to a subpixel circuit illustrated in FIG. 2.

Figure 2:
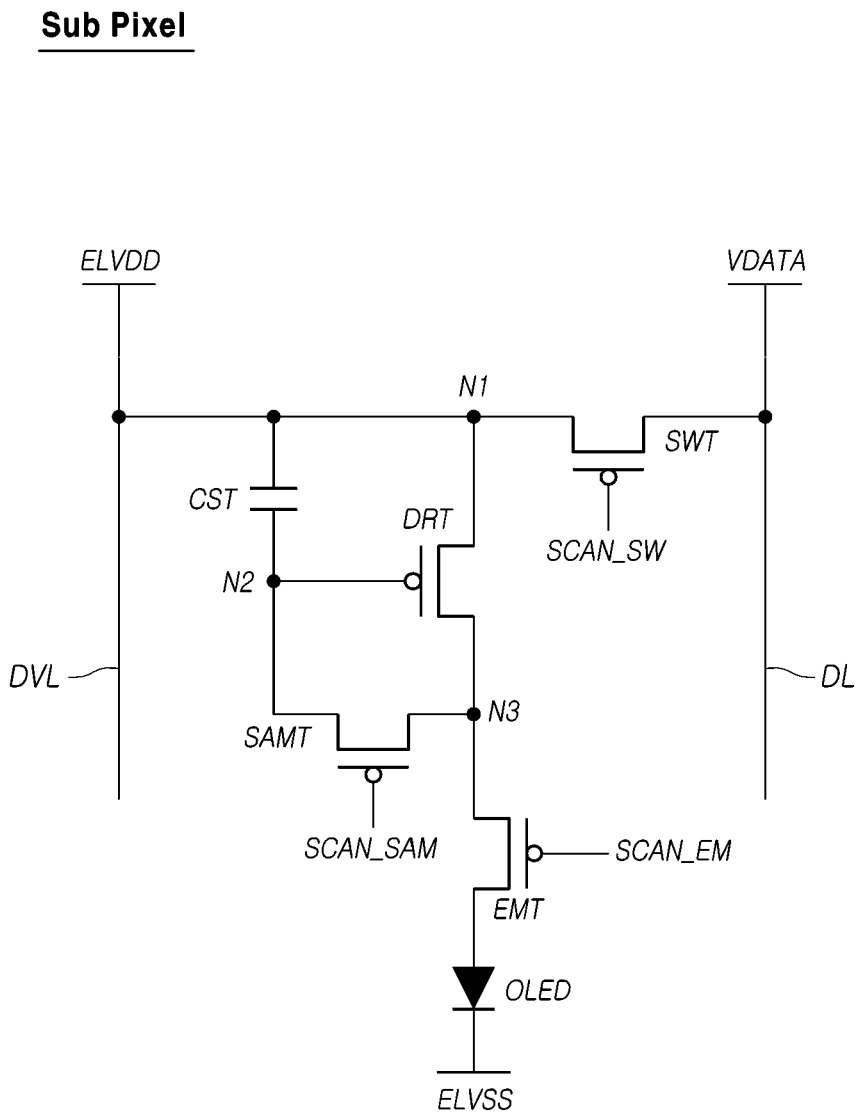
FIG. 2 is a circuit diagram illustrating an example subpixel structure of the display device according to example embodiments.

FIG. 2 is a circuit diagram illustrating an example structure of the subpixel SP of the display device 100 according to example embodiments.

Referring to FIG. 2, each of the plurality of subpixels SP includes: an OLED; a driving transistor DRT receiving a driving voltage ELVDD and driving the OLED; a first transistor SWT electrically connected between a first node N1 of the driving transistor DRT and a data line DL; and a storage capacitor CST electrically connected between the first node N1 and a second node N2 of the driving transistor DRT.

Each of the subpixels SP may further include, in addition to the OLED, the driving transistor DRT, the first switching transistor SWT, and the capacitor CST, one or more transistors and/or one or more capacitors as required.

For example, as illustrated in FIG. 2, each of the subpixels SP includes: the OLED; the driving transistor DRT for driving the OLED, the driving transistor DRT including the first node N1 at which a driving voltage is transferred, the second node N2 corresponding to a gate node, and a third node N3 electrically connected to the OLED; the first transistor SWT electrically connected between the first node N1 of the driving transistor DRT and the data line DL; a second transistor SAMT electrically connected between the second node N2 and the third node N3 of the driving transistor DRT; a third transistor EMT electrically connected between the third node N3 of the driving transistor DRT and the OLED; and the capacitor CST electrically connected between the first node N1 and the second node N2 of the driving transistor DRT.

The OLED may include a first electrode electrically connected to the third node N3 of the driving transistor DRT, an organic light-emitting layer, and a second electrode to which a base voltage ELVSS is applied. The first electrode may be an anode, while the second electrode may be a cathode.

In the driving transistor DRT, the first node N1 may be a source node or a drain node, the second node N2 may be the gate node, and the third node N3 may be the drain node or the source node.

The first node N1 of the driving transistor DRT is electrically connected to a driving voltage line DVL to receive a driving voltage ELVDD.

The driving voltage line DVL may be arranged on every row (or column) of subpixels or in every two rows (or columns) of subpixels.

As illustrated in FIG. 2, each of the subpixels SP further includes the third transistor EMT electrically connected between the third node N3 of the driving transistor DRT and the OLED.

According to the subpixel structure illustrated in FIG. 2, three types of scanning signals SCAN_SW, SCAN_SAM, and SCAN_EM are required to remove on-off states of the first transistor SWT, the second transistor SAMT, and the third transistor EMT.

The first transistor SWT can be on/off controlled by the scanning signal SCAN_SW, also referred to as a switching control signal. The second transistor SAMT can be on/off controlled by the scanning signal SCAN_SAM, also referred to as a sampling control signal. The third transistor EMT can be on/off controlled by the scanning signal SCAN_EM, also referred to as an emission control signal.

In this regard, in the display panel 110, three types of gate lines, through which the three types of scanning signals SCAN_SW, SCAN_SAM, and SCAN_EM are delivered, are arranged on each line of subpixels.

For example, when there are 2880 subpixel lines corresponding to subpixel rows, 3×2880 number of gate lines are provided in the display panel 110.

In addition, the gate driver circuit 130 must transfer the three types of scanning signals SCAN_SW, SCAN_SAM, and SCAN_EM to three gate lines arranged on each of the subpixel lines.

The driving transistors DRT, the first transistor SWT, the second transistor SAMT, and the third transistor EMT may be P-type transistors, as illustrated in FIG. 2, or N-type transistors.

The capacitor CST is an external capacitor intentionally designed to be outside of the driving transistor DRT, instead of being a parasitic capacitor (e.g., Cgs or Cgd), i.e., an internal capacitor present between the first node N1 and the second node N2 of the driving transistor DRT.

The subpixel circuit illustrated in FIG. 2 is only an example; however, one or more transistors may be added, and a capacitor connection structure may be changed as required.

According to the above-described subpixel structure, it is possible to accurately control the voltage state of the second node N2 corresponding to the gate node of the driving transistor DRT by accurately controlling whether or not the second node N2 and the third node N3 of the driving transistor DRT are connected.

Hereinafter, a method of driving the subpixel SP illustrated in FIG. 2 will be described briefly with reference to FIGS. 3 and 4.

Figure 3:
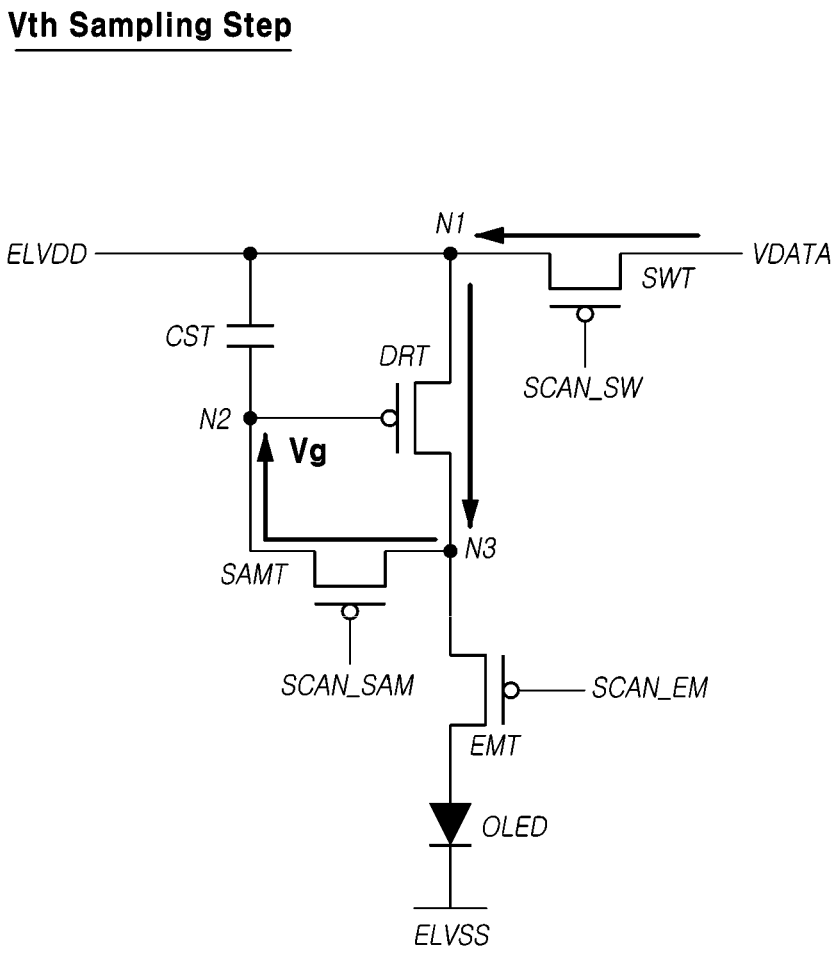
FIG. 3 is a circuit diagram illustrating a threshold voltage sampling step in the case in which the subpixel of the display device according to example embodiments is driven.
Figure 4:
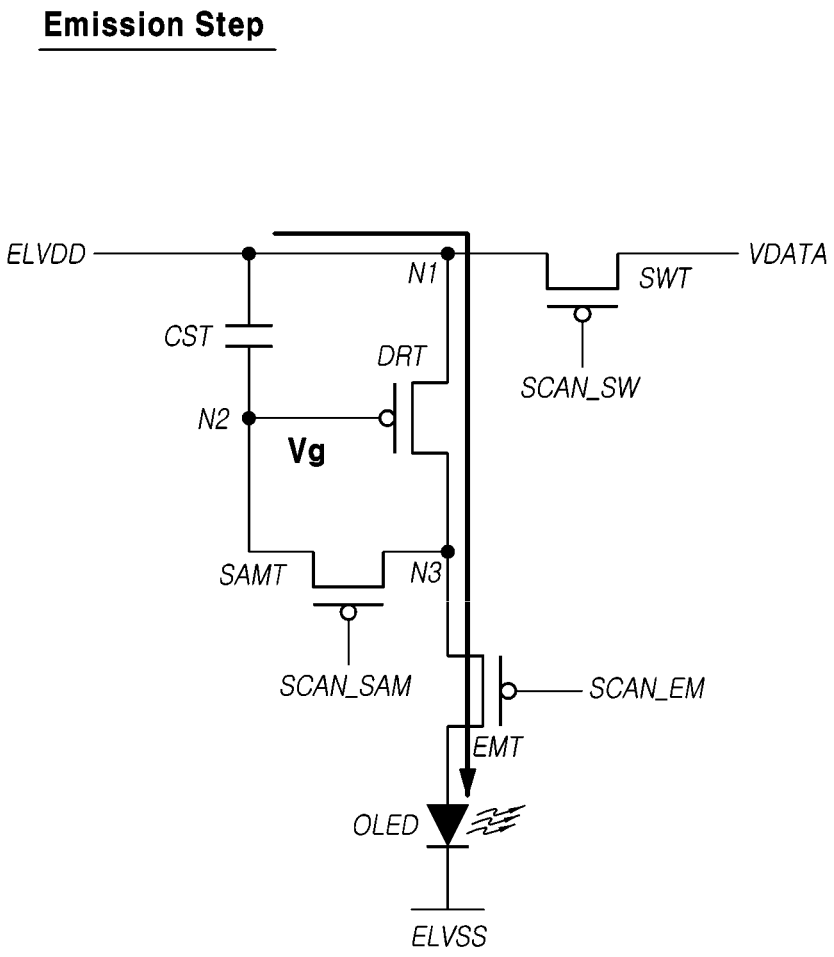
FIG. 4 is a circuit diagram illustrating an emission step in the case in which the subpixel of the display device according to example embodiments is driven.

FIG. 3 is a circuit diagram illustrating a threshold voltage sampling step in the case in which the subpixel SP of the display device 100 according to example embodiments is driven, while FIG. 4 is a circuit diagram illustrating an emission step in the case in which the subpixel SP of the display device 100 according to example embodiments is driven.

Referring to FIGS. 3 and 4, the process of driving the subpixel includes the threshold voltage sampling step (or Vth sampling step) and the emission step.

Referring to FIG. 3, the threshold voltage sampling step is a step of sampling (or sensing) the threshold voltage Vth of the driving transistor DRT.

In the threshold voltage sampling step, the first transistor SWT and the second transistor SAMT may be in turned-on states, and the third transistor EMT may be in a turned-off state.

The switching control signal SCAN_SW and the sampling control signal SCAN_SAM corresponding to scanning signals may be turn-on level voltages (e.g., low level voltages in a case in which the first transistor SWT and the second transistor SAMT are P-type transistors) that can turn on the first transistor SWT and the second transistor SAMT.

The driving transistor DRT may be turned on in the previous step (e.g., the emission step).

A data voltage VDATA is delivered to the second node N2 corresponding to the gate node of the driving transistor DRT through the turned-on first transistor SWT, the turned-on driving transistor DRT, and the turned-on second transistor SAMT.

The data voltage VDATA may be a data voltage for sampling the threshold voltage Vth of the driving transistor DRT.

The data voltage VDATA may be a turn-on level voltage (e.g., a low level voltage in a case in which the first transistor SWT and the second transistor SAMT are P-type transistors) that can turn on the driving transistor DRT.

A voltage (or a gate voltage) Vg of the second node N2 corresponding to the gate node of the driving transistor DRT may be expressed by a formula including the data voltage VDATA and the threshold voltage of the driving transistor DRT.

That is, the gate voltage Vg of the second node N2 corresponding to the gate node of the driving transistor DRT may be expressed as a voltage $Vg=VDATA-|Vth|$ produced by subtracting the threshold voltage Vth of the driving transistor DRT from the data voltage VDATA.

Referring to FIG. 3, the emission step is a step of causing the OLED to emit light.

In the emission step, the driving transistor DRT is in a turned-on state, while the first transistor SWT and the second transistor SAMT are in turned-off states. The third transistor EMT is in a turned-on state.

Thus, the driving transistor DRT can supply a driving current to the OLED by receiving a driving voltage ELVDD, so that the OLED can emit light.

Figure 5:
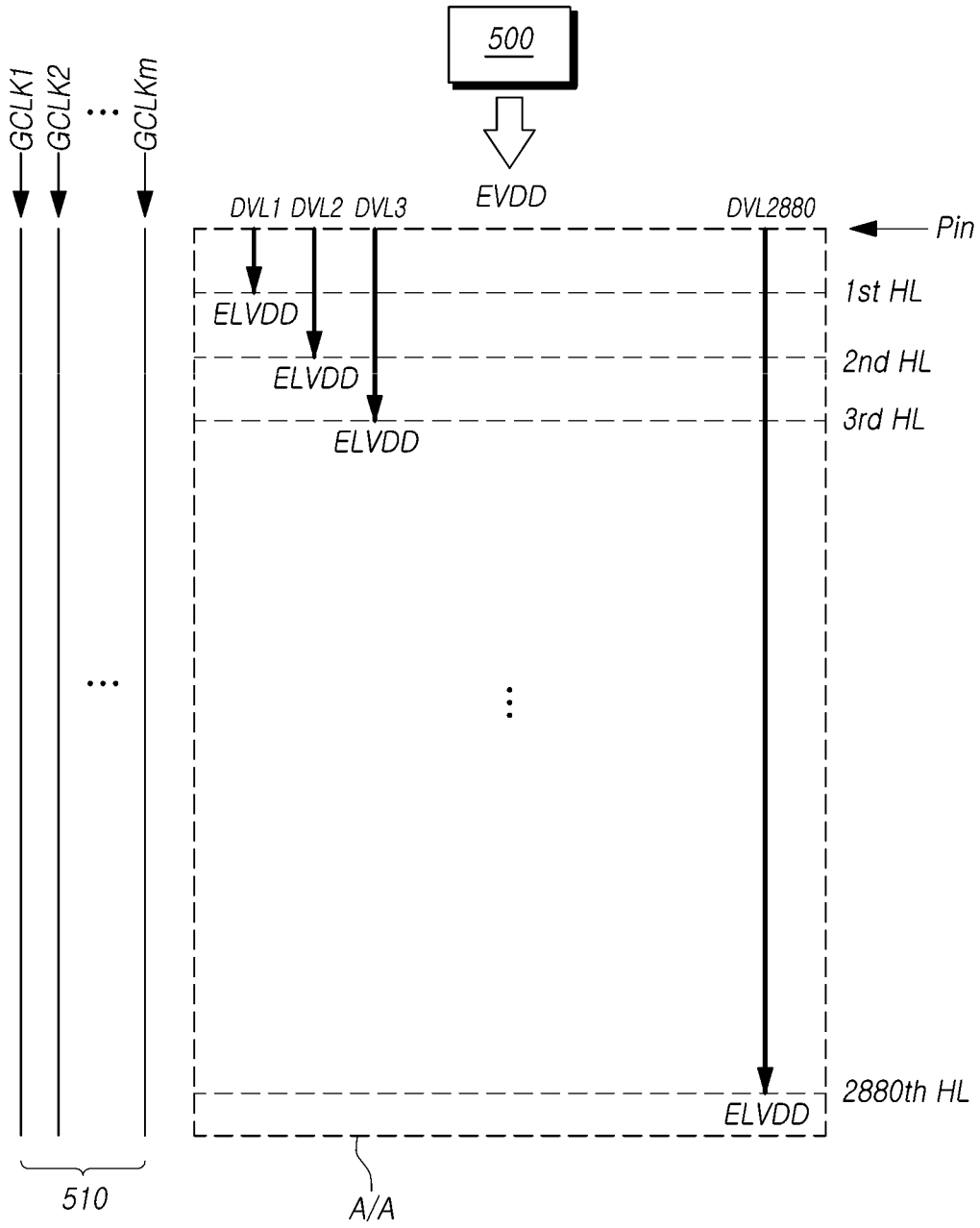
FIG. 5 illustrates horizontal lines in the display panel according to example embodiments and the lengths of paths along which driving voltages are delivered to the horizontal lines.

FIG. 5 illustrates horizontal lines in the display panel 110 according to example embodiments and the lengths of paths on which driving voltages ELVDD are delivered to the horizontal lines.

A plurality of horizontal lines HL are present in the display panel 110.

Each of the horizontal lines HL corresponds to a column of subpixels (i.e., a subpixel line).

In the illustration of FIG. 5, 2,880 horizontal lines 1st HL, 2nd HL, 3rd HL, . . . , and 2,880th HL are provided in the display panel 110.

The display device 100 includes a driving voltage supply circuit 500 supplying the driving voltages ELVDD, necessary for driving the subpixels SP, to the display panel 110.

The driving voltage supply circuit 500 supplies the driving voltages ELVDD to the display panel 110 through the data driver circuit 120 or a flexible printed circuit on which the data driver circuit 120 is mounted.

Driving voltage supply positions Pin at which the driving voltages ELVDD are initially supplied to the display panel 110 are located in the peripheral area of the display panel 110.

More specifically, the positions Pin at which the driving voltages ELVDD are initially supplied to the display panel 110 may be in one edge of the display panel 110, to which the driving voltage supply circuit 500, the data driver circuit 120, or the flexible printed circuit is connected, or may be on both one edge and the other edge of the display panel 110 facing one another, to which the driving voltage supply circuit 500, the data driver circuit 120, or the flexible printed circuit is connected.

Referring to FIG. 5, when a driving voltage line DVL is arranged for every subpixel, driving voltages ELVDD are supplied to the 2,880 horizontal lines 1st HL, 2nd HL, 3rd HL, . . . , and 2,880th HL through 2,880 driving voltage lines DVL1, DVL2, DVL3, . . . , and DVL2,880.

Driving voltage lines, i.e., paths on which the driving voltages ELVDD are supplied to the 2,880 horizontal lines 1st HL, 2nd HL, 3rd HL, . . . , and 2,880th HL, have different lengths depending on the positions of the horizontal lines.

Then, the paths on which the driving voltages ELVDD are supplied to the 2,880 horizontal lines 1st HL, 2nd HL, 3rd HL, . . . , and 2,880th HL have different levels of resistance.

Thus, the driving voltages ELVDD actually applied to the 2,880 horizontal lines 1st HL, 2nd HL, 3rd HL, . . . , and 2,880th HL may differ from one another.

Driving voltages ELVDD actually applied to a horizontal line, among the 2,880 horizontal lines 1st HL, 2nd HL, 3rd HL, . . . , and 2,880th HL, located close to the initial supply positions Pin, have voltage values substantially the same as or very similar to voltage values in the initial supply positions Pin.

However, as a horizontal line, among the 2,880 horizontal lines 1st HL, 2nd HL, 3rd HL, . . . , and 2,880th HL, is located further away from the initial supply positions Pin, driving voltages ELVDD actually applied thereto have a lower voltage value, since the driving voltages ELVDD are dropped by greater amounts while being delivered.

For example, when any two horizontal lines (e.g., the first horizontal line HL1 and the second horizontal line HL2), among all of the horizontal lines 1st HL, 2nd HL, 3rd HL, . . . , and 2,880th HL provided in the display panel 110, are considered, the first horizontal line HL1 is closer to the initial supply positions Pin than the second horizontal line HL2 is. That is, the second horizontal line HL2 is further away from the initial supply positions Pin than the first horizontal line HL1 is.

In this case, the lengths of the paths on which the driving voltages ELVDD are supplied to the subpixels SP in the second horizontal line HL2 may be longer than the lengths of the paths on which the driving voltages ELVDD are supplied to the subpixels SP in the first horizontal line HL1.

Then, due to the greater levels of path resistance and the greater voltage drops, the driving voltages ELVDD actually applied to the subpixels SP in the second horizontal line HL2 may have a voltage value lower than the voltage value of the driving voltages ELVDD actually applied to the subpixels SP in the first horizontal line HL1.

As the driving voltages ELVDD actually applied have different voltage values, depending on the positions of the horizontal lines, horizontal line-specific subpixel driving states (e.g., driving times Tsam in the threshold voltage sampling step) may be varied and horizontal line-specific luminance deviations may occur.

Two or more clock signal lines 510 are arranged outside of an active area A/A, corresponding to a display area of the display panel 100, such that two or more gate clock signals GCLK1, . . . , and GCLKm, where m≥2, necessary for gate driving, are delivered to the gate driver circuit 130 through the two or more clock signal lines 510.

The two or more gate clock signals GCLK1, . . . , and GCLKm may have different phases.

Figure 6:
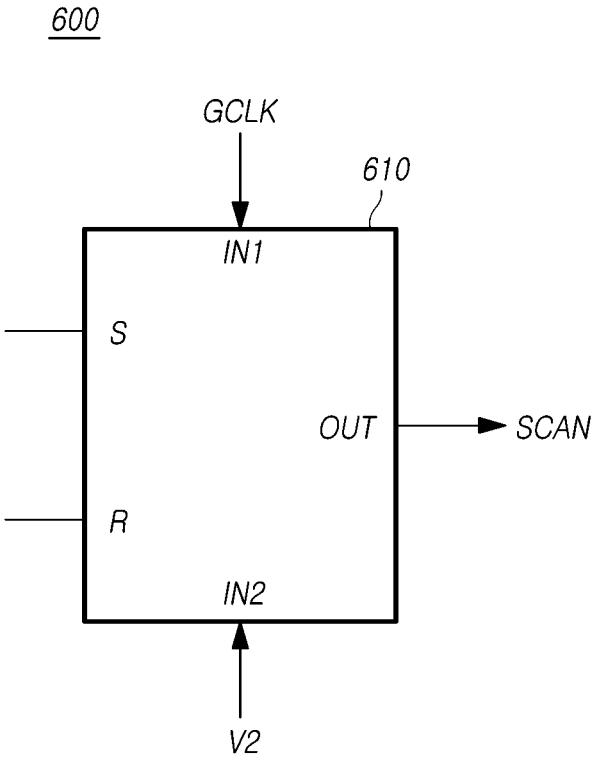
FIG. 6 is a circuit diagram schematically illustrating a gate driver in the gate driver circuit of the display device according to example embodiments.

FIG. 6 is a circuit diagram schematically illustrating a gate driver 600 in the gate driver circuit 130 of the display device 100 according to example embodiments.

Referring to FIG. 6, the gate driver circuit 130 may include a plurality of gate drivers 600 to generate scanning signals SCAN to be output to the gate lines GL, respectively. The plurality of gate drivers 600 are also referred to as stages.

Each of the gate drivers 600 includes a first input node IN1 at which a gate clock signal GCLK having a turn-on level voltage is input, a second input node IN2 at which a supply voltage V2 having a turn-off level voltage is input, a signal generating circuit 610 generating a scanning signal SCAN in response to the gate clock signal GCLK, and an output node OUT at which the scanning signal SCAN is output to a gate line GL corresponding thereto.

Each of the gate drivers 600 further includes a start node S at which a start signal is input and a reset node R at which a reset node is input.

The signal generating circuit 610 may include a pull-up transistor and a pull-down transistor. The signal generating circuit 610 may further include a driver (not shown) driving the pull-up transistor and the pull-down transistor by controlling a gate node (i.e., a Q node or a QB node) of the pull-up transistor and a gate node (i.e., a QB node or a Q node) of the pull-down transistor. The driver may include one or more transistors.

The signal generating circuit 610 outputs a corresponding pulse among a plurality of pulses of the gate clock signal GCLK, as a scanning signal SCAN, at a corresponding point in time. That is, a turn-on level section of the scanning signal, intended to turn a corresponding transistor on, is the same as the corresponding pulse among the plurality of pulses of the gate clock signal GCLK.

Figure 7:
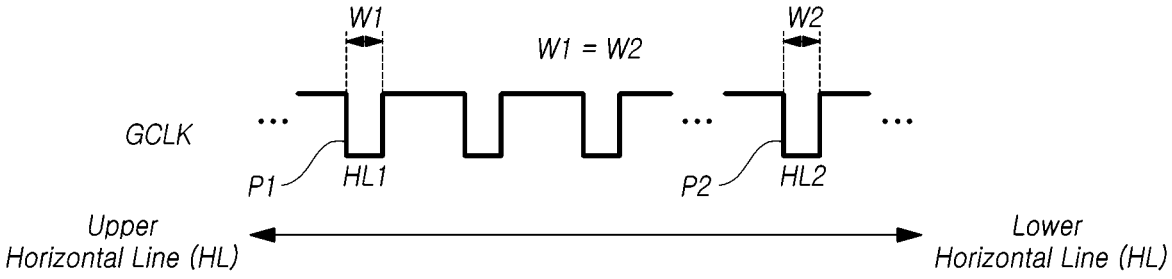
FIG. 7 illustrates a gate clock signal used for gate driving in the display device according to example embodiments.

FIG. 7 illustrates a gate clock signal GCLK used for gate driving in the display device 100 according to example embodiments.

As described above, the gate driver circuit 130 uses two or more gate clock signals GCLK having different phases to generate scanning signals SCAN, such as a switching control signal SCAN_SW, a sampling control signal SCAN_SAM, and an emission control signal SCAN_EM.

Each of the gate clock signals GCLK includes a plurality of pulses vibrating between a high level voltage and a low level voltage.

In the case in which the first, second, and third transistors SWT, SAMT, and EMT are P-type transistors, in each of the gate clock signals GCLK, the low level voltage corresponds to a turn-on level voltage, while the high level voltage corresponds to a turn-off level voltage.

In a plurality of pulses included in each of the gate clock signals GCLK, each of the pulses corresponds to a single horizontal line.

The pulses included in each of the gate clock signals GCLK have the same pulse width (e.g., the width of a low level voltage range).

Referring to the example of FIG. 7, referring to a first pulse P1 and a second pulse P2 among a plurality of pulses included in each of the gate clock signals GCLK, the pulse width W1 of the first pulse P1 and the pulse width W2 of the second pulse P2 are the same.

The first pulse P1 corresponds to the first horizontal line HL1 of the display panel 110.

The second pulse P2 corresponds to the second horizontal line HL2 of the display panel 110, located below (or next to) the first horizontal line HL1.

The second horizontal line HL2 is a horizontal line located further away from the driving voltage initial supply positions Pin than the first horizontal line HL1 is.

Figure 8:
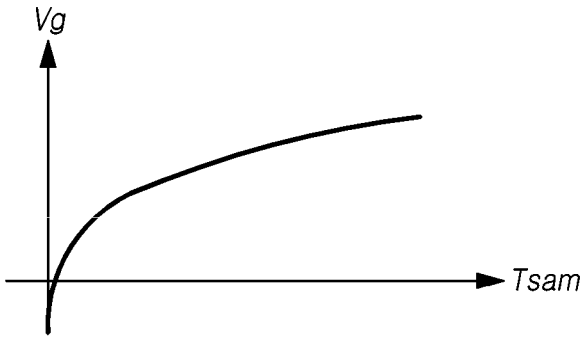
FIG. 8 is a graph of gate voltage over threshold voltage sampling time of a driving transistor in a subpixel of the display device according to example embodiments.

FIG. 8 is a graph of gate voltage Vg over threshold voltage sampling time Tsam of a driving transistor DRT in a subpixel SP of the display device 100 according to example embodiments.

Referring to FIG. 8, in the threshold voltage sampling step, a longer threshold voltage sampling time Tsam increases the gate voltage Vg of the driving transistor DRT.

In contrast, in the threshold voltage sampling step, a shorter threshold voltage sampling time Tsam reduces the gate voltage Vg of the driving transistor DRT.

When the threshold voltage sampling time Tsam increases, the gate voltage Vg of the driving transistor DRT is increased. Thus, the driving transistor DRT, e.g., a P-type transistor, is turned on for a shorter period of time, so that the corresponding pixel emits light for a shorter period of time, thereby having a lower luminance level.

When the threshold voltage sampling time Tsam decreases, the gate voltage Vg of the driving transistor DRT is reduced. Thus, the driving transistor DRT, a P-type transistor, is turned on for a longer period of time, so that the corresponding pixel emits light for a longer period of time, thereby having a higher luminance level.

Figure 9:
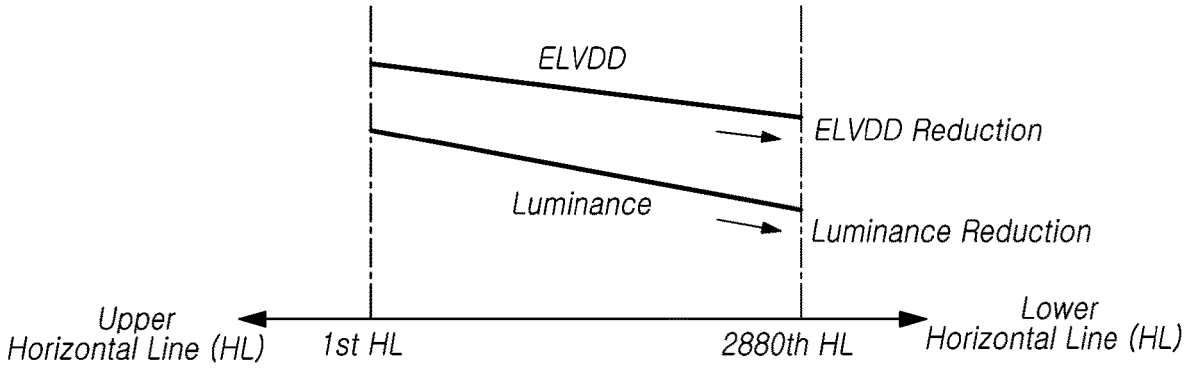
FIG. 9 is a graph illustrating driving voltages applied to horizontal lines depending on the positions of the horizontal lines and luminance levels of the horizontal lines depending on the positions of the horizontal lines in the display device according to example embodiments.

FIG. 9 is a graph illustrating driving voltages ELVDD applied to horizontal lines depending on the positions of the horizontal lines and luminance levels of the horizontal lines depending on the positions of the horizontal lines in the display device 100 according to example embodiments.

Referring to FIG. 9, in a case in which 2,880 horizontal lines 1st HL, 2nd HL, 3rd HL, . . . , and 2,880th HL are present in the display panel 110, the first horizontal line 1st HL is closest to the driving voltage initial supply positions Pin, and the last horizontal line 2,880th HL is farthest from the driving voltage initial supply positions Pin, driving voltages ELVDD actually applied to horizontal lines will be described.

In the display panel 110, in the case of upper horizontal line being closer to the driving voltage initial supply positions Pin, i.e., as the position of the horizontal line moves from the 2,880th horizontal line farthest from the driving voltage initial supply positions Pin toward the first horizontal line 1st HL closest to the driving voltage initial supply positions Pin, the amount of voltage drop decreases, such that the level of the driving voltages actually applied may become higher.

In contrast, in the display panel 110, in the case of lower horizontal line being farther from the driving voltage initial supply positions Pin, i.e., as the position of the horizontal line moves from the first horizontal line 1st HL closest to the driving voltage initial supply positions Pin toward the 2,880th horizontal line farthest from the driving voltage initial supply positions Pin, the amount of voltage drop increases, such that the level of the driving voltages actually applied may become lower.

Here, an upper horizontal line being closer to the driving voltage initial supply positions Pin is used as an illustrative example for descriptive purposes only. It should be appreciated that it is possible that a lower horizontal line is closer to the driving voltage initial supply positions Pin than an upper horizontal line, which is also included in the disclosure.

In this case, in the display panel 110, in the case of lower horizontal line being farther from the driving voltage initial supply positions Pin, i.e., as the position of the horizontal line moves from the first horizontal line 1st HL closest to the driving voltage initial supply positions Pin toward the 2,880th horizontal line farthest from the driving voltage initial supply positions Pin, the luminance of the corresponding subpixel is lowered.

Thus, due to driving voltage deviations depending on the positions of the horizontal lines, luminance deviations depending on the positions of the horizontal lines may occur. This may cause non-uniformity in luminance, thereby degrading the quality of images.

Herein, a driving method for solving the above-described phenomenon, in which voltage drops in driving voltages ELVDD and resultant horizontal line-specific driving voltage deviations in the display panel 110 may cause horizontal line-specific luminance deviations in the display panel 110, even in a case in which gate voltages Vg of the driving transistors DRT are input equally when patterns having the same luminance are displayed for predetermined threshold voltage sampling times Tsam, depending the positions of the horizontal lines in the display panel 110, will be described.

Figure 10:
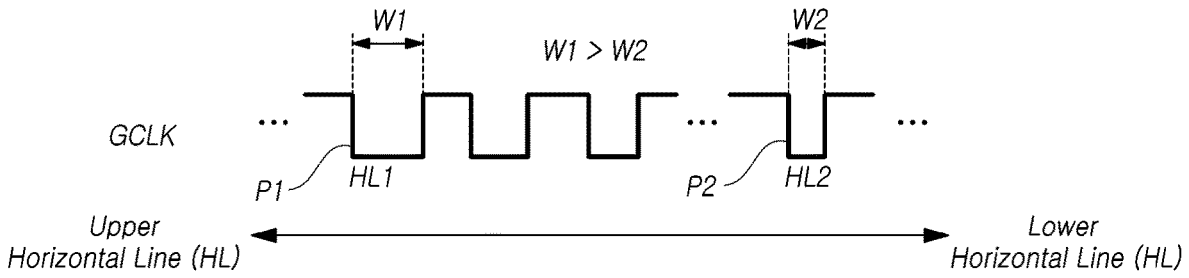
FIG. 10 illustrates a gate clock signal used for gate driving in the display device according to example embodiments, the pulse width of the gate clock signal being adjusted depending on the positions of horizontal lines.
Figure 11:
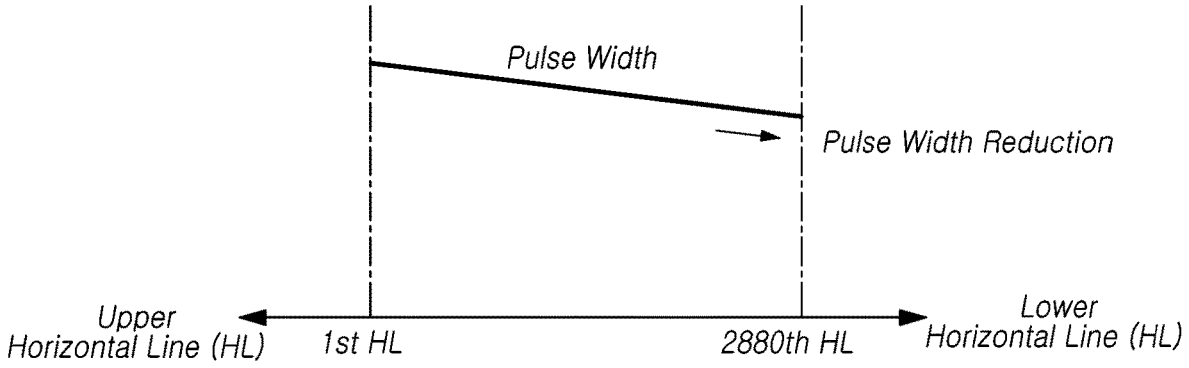
FIG. 11 is a graph illustrating the pulse width of the gate clock signal, depending on the positions of the horizontal lines in the display device according to example embodiments.
Figure 12:
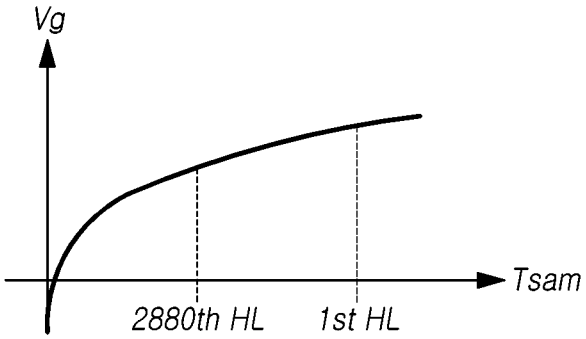
FIG. 12 is a graph illustrating a gate voltage over threshold voltage sampling time of a driving transistor in a subpixel of the display device according to example embodiments.
Figure 13:
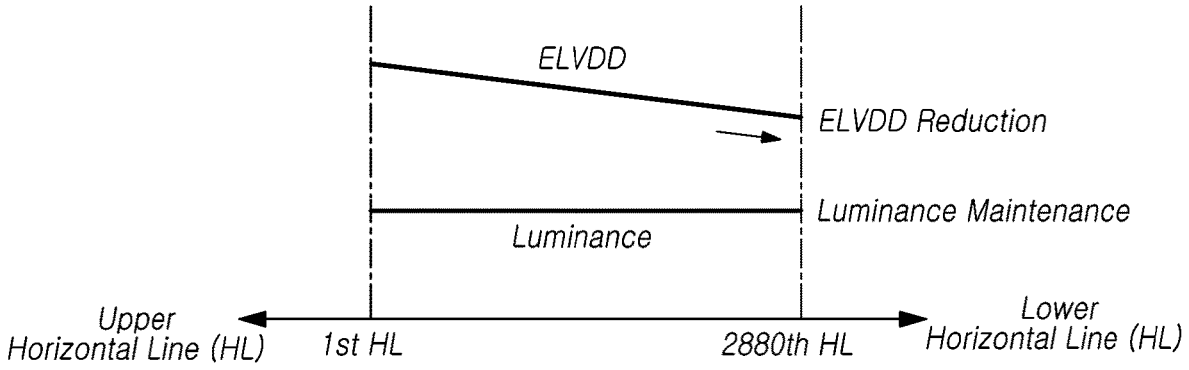
FIG. 13 is a graph illustrating driving voltages applied to horizontal lines, depending on the positions of the horizontal lines and luminance levels in the horizontal lines depending on the positions of the horizontal lines, compensated for by pulse width adjustment, in the display device according to example embodiments.

FIG. 10 illustrates a gate clock signal GCLK used for gate driving in the display device 100 according to example embodiments, the pulse width of the gate clock signal GCLK being adjusted depending/based on the positions of horizontal lines, FIG. 11 is a graph illustrating the pulse width of the gate clock signal GCLK, depending on/with respect to the positions of the horizontal lines in the display device 100 according to example embodiments, FIG. 12 is a graph illustrating a gate voltage Vg over threshold voltage sampling time Tsam of a driving transistor DRT in a subpixel SP of the display device 100 according to example embodiments, and FIG. 13 is a graph illustrating driving voltages ELVDD applied to horizontal lines, depending on/with respect to the positions of the horizontal lines and luminance levels in the horizontal lines with respect to the positions of the horizontal lines, compensated for by pulse width adjustment, in the display device 100 according to example embodiments.

The display device 100 according to example embodiments provides a driving method for compensating for voltage drops in the driving voltages ELVDD in the display panel 110, as well as horizontal line-specific luminance deviations in the display panel 110, caused by deviations in the voltage drop.

As described above, the gate driver circuit 130 generates a scanning signal SCAN using two or more gate clock signals GCLK having different phases and transfers the scanning signal to the plurality of gate lines GL.

The scanning signal SCAN includes one or more of a switching control signal SCAN_SW applied to the gate node of the first transistor SWT, a sampling control signal SCAN_SAM applied to a gate node of the second transistor SAMT, and an emission control signal SCAN_EM applied to the gate node of the third transistor EMT.

Each of the two or more gate clock signals GCLK includes a plurality of pulses.

Among the plurality of pulses of each of the two or more gate clock signals GCLK, a first pulse P1 and a second pulse P2, following the first pulse P1, are included.

In each of the two or more gate clock signals GCLK, the pulse width W1 of the first pulse P1 can be different from the pulse width W2 of the second pulse P2.

The plurality of pulses of each of the two or more gate clock signals GCLK may correspond to horizontal lines, respectively.

Among the plurality of pulses of each of the two or more gate clock signals GCLK, the first pulse P1 corresponds to the first horizontal line HL1, and the second pulse P2 corresponds to the second horizontal line HL2.

Since the second pulse P2 is following the first pulse P1, the second horizontal line HL2, corresponding to the second pulse P2, is illustrated as being located below the first horizontal line HL1 corresponding to the first pulse P1 in the drawing.

In the display panel 110, the second horizontal line HL2 corresponding to the second pulse P2 is located farther from the driving voltage supply positions Pin than the first horizontal line HL1 corresponding to the first pulse P1. The second pulse P2 corresponds to a turn-on level section pulse of a scanning signal supplied to a gate line arranged on the second horizontal line HL2. The first pulse P1 corresponds to a turn-on level section pulse of a scanning signal supplied to a gate line arranged on the first horizontal line HL1.

As described above, scanning signals SCAN having different pulse widths based/depending on the positions of the horizontal lines are supplied to the display panel 110. Even in the case in which horizontal line-specific driving voltage deviations occur in the entire area of the display panel 110, the horizontal line-specific driving voltage deviations can be compensated for, thereby improving the uniformity of luminance and the quality of displayed images.

Since the scanning signals SCAN having different pulse widths based/depending on the positions of the horizontal lines are supplied to the display panel 110, the threshold voltage sampling time Tsam may be changed when the subpixels are driven based/depending on the horizontal lines.

As described above, the second horizontal line HL2 corresponding to the second pulse P2 is located farther from the driving voltage supply positions Pin than the first horizontal line HL1 corresponding to the first pulse P1 is. Thus, the paths on which the driving voltages ELVDD are delivered to the subpixels SP on the second horizontal line HL2 are longer than the paths on which the driving voltages ELVDD are delivered to the subpixels SP on the first horizontal line HL1.

The driving voltages ELVDD actually applied to the subpixels SP on the second horizontal line HL2 may be lower than the driving voltages ELVDD actually applied to the subpixels SP on the first horizontal line HL1.

Thus, the subpixels SP arranged on the second horizontal line HL2 may emit light having a lower level of luminance than the subpixels SP arranged on the first horizontal line HL1, since the subpixels SP on the second horizontal line HL2 emit light using the lower driving voltages ELVDD.

According to example embodiments, the gate driver circuit 130 can transfer scanning signals SCAN having different pulse widths, based/depending on the horizontal lines corresponding to the subpixel lines, in order to compensate for the horizontal line-specific luminance deviations.

When the scanning signals SCAN having different pulse widths based/depending on the horizontal lines are transferred to the display panel 110, as described above, the horizontal line-specific luminance deviations can be compensated for.

More specifically, the gate driver circuit 130 can transfer scanning signals having smaller pulse widths to gate lines arranged on a horizontal line located farther from the driving voltage supply positions Pi at which the driving voltages ELVDD are supplied to the display panel 110.

In other words, in a case in which the driving voltage supply positions Pin are referred to as being on the upper edge of the display panel 110 (in the drawing, e.g., FIG. 5), a gate line corresponding to a lower horizontal line, i.e., a horizontal line closer to the 2,880th horizontal line 2,880th HL farthest from the first horizontal line 1st HL closet to the driving voltage supply positions Pi, is provided with scanning signals SCAN_SW and SCAN_SAM having smaller pulse widths.

In this regard, subpixels arranged on a lower horizontal line have shorter threshold voltage sampling times Tsam, such that gate voltages Vg of the driving transistors DRT may be further reduced.

Thus, the P-type driving transistors DRT are turned on for a longer period of time, so that the OLEDs can be supplied with greater amounts of current to have higher luminance levels.

It should be appreciated that an N-type driving transistor may also be used and included in the disclosure. For an N-type driving transistor to be turned on for a longer period of time, the gate voltage may need to be further increased which may require a larger pulse width of the scanning signals. Other implementation variants in using varied pulse widths in scanning signals to compensate for the driving voltage variation among horizontal lines are also possible and included in the disclosure.

Consequently, even in the case in which the subpixels arranged on the lower horizontal line are supplied with lower driving voltages, the pulse width adjustment of the scanning signals SCAN_SW and SCAN_SAM can compensate for luminance reductions in the subpixels arranged on the lower horizontal line.

For the pulse width adjustment of the scanning signals SCAN_SW and SCAN_SAM, in each of the gate clock signals GCLK necessary for the generation of scanning signals, the width W2 of the second pulse P2 following the first pulse P1 is smaller than the width W1 of the first pulse P1, in the example scenario of the driving transistors being P-type transistors.

Thus, the scanning signals SCAN_SW and SCAN_SAM having smaller pulse widths can be supplied to the gate line arranged on the lower horizontal line. In other words, the turn-on level section of the scanning signal generated by the first pulse P1 is a signal corresponding to the first pulse P1, while the turn-on level section of the scanning signal generated by the second pulse P2 is a signal corresponding to the second pulse P2.

In addition, as the subpixels are arranged on a lower horizontal line, operations for threshold voltage sampling are performed for shorter period of times (i.e., for shorter threshold voltage sampling times Tsam). As a consequence, the relevant gate voltage Vg of the P-type driving transistor will be lower and the P-type driving transistor will be turned on for a longer period of time to compensate for the lower driving voltage.

The above-described method of driving the display device 100 according to example embodiments will be briefly described again.

Figure 14:
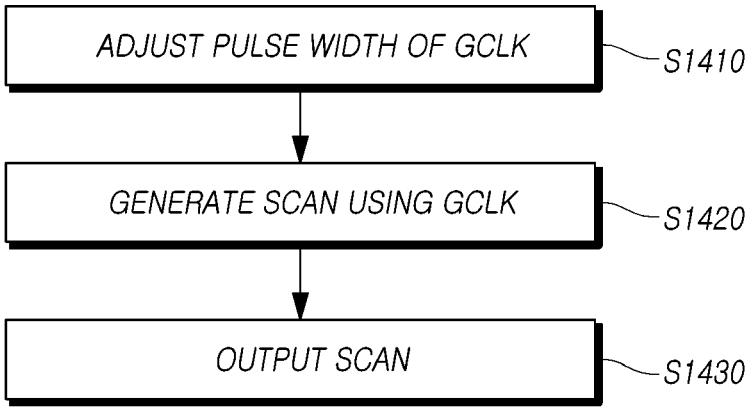
FIG. 14 is a flowchart illustrating the method of driving the display device according to example embodiments.

FIG. 14 is a flowchart illustrating the method of driving the display device 100 according to example embodiments.

Referring to FIG. 14, the method of driving the display device 100 according to example embodiments includes: step S1410 of adjusting pulse widths of two or more gate clock signals GCLK having different phases; step S1420 of generating scanning signals SCAN using the gate clock signals GCLK; and step S1430 of outputting the scanning signals SCAN to the gate lines GL.

In the step S1410 of adjusting pulse widths, each of the two or more gate clock signals GCLK includes a plurality of pulses, including a first pulse P1 and a second pulse P2 following the first pulse P1. In each of the gate clock signals GCLK, the pulse width W1 of the first pulse P1 and the pulse width W2 of the second pulse P2 can be adjusted to be different.

According to the above-described driving method, even in the case in which horizontal line-specific driving voltage deviations occur in the entire area of the display panel 110, the horizontal line-specific driving voltage deviations can be compensated for, thereby improving the uniformity of luminance and the quality of displayed images.

In the step S1410 of adjusting pulse widths, in each of the gate clock signals GCLK, the first pulse P1 corresponds to the first horizontal line HL1, and the second pulse P2 corresponds to the second horizontal line HL2 located farther from the driving voltage supply positions Pin than the first horizontal line HL1 is.

In the step S1410 of adjusting pulse widths, in each of the gate clock signals GCLK, the pulse width W2 of the second pulse P2 can be adjusted to be smaller than the width W1 of the first pulse P1.

Since the scanning signals SCAN are generated by the adjustment of the pulse widths, in the display panel 110, a scanning signal transferred to a gate line on a lower horizontal line located farther from the driving voltage supply positions Pin has a smaller pulse width.

Consequently, even in the case in which a lower driving voltage is supplied due to a greater voltage drop, compensation of raising luminance by a luminance level lowered by the lower driving voltage can be provided. It is therefore possible to improve the uniformity of luminance across the entire area of the display panel 110.

In the display device 100, the display panel 110, the display method, and the gate driver circuit 130 according to example embodiments as set forth above, it is possible to improve the luminance uniformity of the display panel 110, even in the case in which position-specific driving voltage deviations occur in the display panel.

In addition, in the display device 100, the display panel 110, the display method, and the gate driver circuit 130 according to example embodiments, it is possible to improve the luminance uniformity of the display panel 110, even in the case in which the driving transistors DRT have different threshold voltage sampling times Tsam.

Furthermore, in the display device 100, the display panel 110, the display method, and the gate driver circuit 130 according to example embodiments, it is possible to improve the luminance uniformity of the display panel 110 by changing threshold voltage sampling times Tsam of the driving transistors DRT.

In addition, in the display device 100, the display panel 110, the display method, and the gate driver circuit 130 according to example embodiments, it is possible to improve the luminance uniformity of the display device 110 by changing the threshold voltage sampling times Tsam of the driving transistors DRT by varying pulse widths of gate pulse signals GCLK.

Furthermore, in the display device 100, the display panel 110, the display method, and the gate driver circuit 130 according to example embodiments, it is possible to improve the luminance uniformity of the display device 110 by changing the threshold voltage sampling times Tsam of the driving transistors DRT by varying pulse widths of scanning signals SCAN.

The foregoing descriptions and the accompanying drawings have been presented in order to explain the certain principles of the present disclosure. A person skilled in the art to which the present disclosure relates could make many modifications and variations by combining, dividing, substituting for, or changing the elements without departing from the principle of the present disclosure. The foregoing embodiments disclosed herein shall be interpreted as illustrative only but not as limitative of the principle and scope of the present disclosure. It should be understood that the scope of the present disclosure shall be defined by the appended claims and all of their equivalents fall within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device comprising:

a display panel including a plurality of data lines, a plurality of gate lines, and an array of a plurality of subpixels defined by the plurality of data lines and the plurality of gate lines; and a gate driver circuit for generating scanning signals using two or more gate clock signals having different phases and for transferring the scanning signals to the plurality of gate lines, each of the clock signals including a first pulse and a second pulse following the first pulse, the first pulse and the second pulse having different pulse widths configured to drive two or more sub-pixels with different time periods of emitting light;

wherein the gate driver circuit transfers the scanning signal having a shorter pulse width by a shorter pulse width of the gate clock signal to a gate line arranged on a horizontal line, which is located farther from a driving voltage supply position at which a driving voltage is supplied to the display panel, so as to have shorter threshold voltage sampling time, wherein each of the plurality of subpixels includes:

an organic light-emitting diode;

a driving transistor for driving the organic light-emitting diode, the driving transistor comprising a first node connected to a driving voltage, a second node corresponding to a gate node, and a third node electrically connected to the organic light-emitting diode;

a first transistor electrically connected between the first node of the driving transistor and a data line among the plurality of data lines;

a second transistor electrically connected between the second node and the third node of the driving transistor; and a capacitor electrically connected between the first node and the second node of the driving transistor.

2. The display device according to claim 1, wherein the first pulse corresponds to a first horizontal line in the display panel, and the second pulse corresponds to a second horizontal line in the display panel, the second horizontal line being located farther from a driving voltage supply position than the first horizontal line.

3. The display device according to claim 2, wherein a path on which a driving voltage is delivered to a subpixel, among the plurality of subpixels, disposed on the second horizontal line, is longer than a path on which a driving voltage is delivered to a subpixel, among the plurality of subpixels, disposed on the first horizontal line.

4. A method of driving a display device which includes a display panel comprising an arrangement of a plurality of data lines, an arrangement of a plurality of gate lines, and an array of a plurality of subpixels defined by the plurality of data lines and the plurality of gate lines, the method comprising:

sensing a first threshold voltage sampling time of a first driving transistor connected to a first gate line of the plurality of gate lines;

sensing a second threshold voltage sampling time of a second driving transistor connected to a second gate line of the plurality of gate lines, the second gate line being located farther from a driving voltage supply position than the first gate line;

determining a gate voltage of each of the first and second driving transistors in response to the first and second threshold voltage sampling time, respectively, adjusting pulse widths of two or more gate clock signals based on a location of each first and second gate line with respect to the driving voltage supply position within the display panel and the gate voltage of each of the first and second driving transistors, the pulse widths having different phases in a manner that for each of the two or more gate clock signals having a first pulse and a second pulse following the first pulse, pulse widths of the first pulse and the second pulse are adjusted to be different, wherein the first pulse corresponds to the first gate line and the second pulse corresponds to a second gate line;

generating scanning signals in response to the gate clock signal; and outputting the scanning signals to a plurality of gate lines, the scanning signals configured to drive two or more subpixels associated with the plurality of gate lines with different time durations, wherein the scanning signal having a shorter pulse width by a shorter pulse width of the gate clock signal is transferred to a gate line arranged on a horizontal line, which is located farther from a driving voltage supply position at which a driving voltage is supplied to the display panel, so as to have shorter threshold voltage sampling time.

5. A display panel comprising:

a plurality of data lines configured to deliver data voltages;

a plurality of gate lines configured to deliver scanning signals;

two or more gate clock signal lines configured to deliver two or more gate clock signals having different phases, each of the gate clock signals including a plurality of pulses including a first pulse and a second pulse following the first pulse, the first pulse and the second pulse having different pulse widths; and a plurality of subpixels adjacently positioned to the plurality of data lines and the plurality of gate lines, wherein each of the plurality of subpixels includes:

an organic light-emitting diode, a driving transistor for driving the organic light-emitting diode, the driving transistor comprising a first node connected to a driving voltage, a second node corresponding to a gate node, and a third node electrically connected to the organic light-emitting diode;

a first transistor electrically connected between the first node of the driving transistor and a data line among the plurality of data lines;

a second transistor electrically connected between the second node and the third node of the driving transistor; and a capacitor electrically connected between the first node and the second node of the driving transistor;

wherein the different pulse widths are configured to drive two or more subpixels of the plurality of subpixels with different time periods of emitting light;

wherein the pulse width of the gate clock signal for the gate line which is located farther from a driving voltage supply position, is shorter than the pulse width of the gate clock signal for the gate line which is located closer from the driving voltage supply position, so as to have shorter pulse width of the scanning signal and shorter pulse width of a threshold voltage sampling time.

6. The display panel according to claim 5, further comprising a gate driver circuit, the gate driver circuit comprising:

a first input node configured to receive a gate clock signal, the gate clock signal including a plurality of pulses including a first pulse and a second pulse following the first pulse, the first pulse and the second pulse having different pulse widths configured to drive two or more subpixels with different time periods;

a second input node configured to receive a power voltage;

a signal generating circuit configured to generate a scanning signal in response to the gate clock signal; and an output node configured to output the scanning signal to a gate line, the signal generating circuit generates the scanning signal having a shorter pulse width to a gate line arranged on a horizontal line, which is located farther from a driving voltage supply position at which a driving voltage is supplied to a display panel, so as to have shorter threshold voltage sampling time.

7. A display device comprising:

a display panel having a plurality of data lines, a plurality of gate lines, and an array of a plurality of subpixels adjacently arranged in overlapping locations of the plurality of data lines and the plurality of gate lines; and a gate driver circuit for generating scanning signals using two or more gate clock signals having different phases configured to drive two or more subpixels of the plurality of subpixels with different time periods of emitting light and for transferring the scanning signals to the plurality of gate lines in a manner that the gate driver circuit transfers the scanning signals having different pulse widths based on horizontal lines corresponding to subpixel lines of the plurality of subpixels, wherein the gate driver circuit transfers the scanning signal having a shorter pulse width to a gate line arranged on a horizontal line, which is located farther from a driving voltage supply position at which a driving voltage is supplied to the display panel, so as to have shorter threshold voltage sampling time, wherein each of the subpixels of the array of a plurality of subpixels includes:

an organic light-emitting diode;

a driving transistor for driving the organic light-emitting diode, the driving transistor comprising a first node connected to a driving voltage, a second node corresponding to a gate node, and a third node electrically connected to the organic light-emitting diode;

a first transistor electrically connected between the first node of the driving transistor and a data line among the plurality of data lines;

a second transistor electrically connected between the second node and the third node of the driving transistor; and a capacitor electrically connected between the first node and the second node of the driving transistor.

8. The display device according to claim 7, wherein the gate driver circuit transfers a scanning signal of the scanning signals, having a shorter pulse width, to a gate line, among the plurality of gate lines, arranged on a horizontal line of the horizontal lines, which is located farther from a driving voltage supply position at which a driving voltage is supplied to the display panel.

9. A method, comprising:

identifying a first subpixel and a second subpixel on a display panel, the first subpixel having a first voltage delivery distance from a driving voltage supply position and the second subpixel having a second different voltage delivery distance from the driving voltage supply position; and controlling to turn on a driving transistor of the first subpixel for a first time period to drive the first subpixel for emitting light and to turn on a driving transistor of the second subpixel for a second different time period which is different from the first time period, to drive the second subpixel for emitting light, the controlling including:

sampling a threshold voltage of the driving transistor of the first subpixel with a first sampling period;

sampling a threshold voltage of the driving transistor of the second subpixel with a second different sampling period;

using a first pulse with a first pulse width of a scanning signal to sample the threshold voltage of the driving transistor of the first subpixel;

using a second pulse with a second different pulse width of the scanning signal to sample the threshold voltage of the driving transistor of the second subpixel; and determining a first gate voltage of the driving transistor in the first subpixel and a second different gate voltage of the driving transistor in the second subpixel in response to the first and second sampling period, respectively, wherein the second voltage delivery distance of the second subpixel is longer than the first voltage delivery distance of the first subpixel, and the second time period of the driving transistor of the second subpixel being turned on is longer than the first time period of the driving transistor of the first subpixel being turned on by a shorter pulse width of the gate clock signal for the gate line which is located farther from a driving voltage supply position than the pulse width of the gate clock signal for the gate line located closer from the driving voltage supply position, so as to have shorter pulse width of the scanning signal and shorter pulse width of a threshold voltage sampling time.

* * * * *